United States Patent [19]

Arcara

[11] 4,241,924

[45] Dec. 30, 1980

[54] OLYMPIC EVENT BOARD GAME

[76] Inventor: Frank J. Arcara, 145-77 4th Ave., Whitestone, N.Y. 11357

[21] Appl. No.: 7,595

[22] Filed: Jan. 29, 1979

[51] Int. Cl.[3] ..... A63F 3/00

[52] U.S. Cl. ..... 273/277; 273/409

[58] Field of Search ..... 273/244, 246, 248, 249, 273/409

[56] References Cited

U.S. PATENT DOCUMENTS 103,774 5/1870 Plumb ..... 273/138 R

FOREIGN PATENT DOCUMENTS 136759 3/1950 Australia ..... 273/108

1814111 6/1970 Fed. Rep. of Germany ..... 273/244

*Primary Examiner*—Richard C. Pinkham

*Assistant Examiner*—R. Carl Moy

*Attorney, Agent, or Firm*—Richard L. Miller

[57] ABSTRACT

A board game which simulates olympic athletic events by utilizing a pair of dice for selecting one of a set of cards which determines the number of points scored for a particular athletic event. The game includes a playing board having a plurality of concentrically increasing scoring areas, one of which represents a penalty area and the other of which represents multiplier areas. A series of event playing stations are formed peripherally around the playing board with each playing station identified by a particular athletic event. A set of cards is associated with each of the event playing stations. Each card within a set has one side identified with the particular athletic event of the associated station. The other side of each card within the set contains a particular playing condition and point achievement score. A pair of dice is used to select one of the cards from a particular set. Scoring sheets are utilized for tabulating the scores. The events are listed on each one of the scoring sheets.

9 Claims, 2 Drawing Figures

OLYMPIC EVENT BOARD GAME

BACKGROUND OF THE INVENTION

This invention relates to board games and more particularly to a board game simulating athletic events of the olympic games. Numerous board games are presently available which utilize chance determining means for playing and winning the game. However, most of the board games are generally of a simple type having very few possibilities of movement, very few variations, simplified scoring and unattractive playing situations. As a result, board games which use chance determining means are not very attractive and are often not played.

In some chance determining board games the particular chance determining means such as the dice, spinner or the like, determines the number of moves to be made around the playing field. In others, the chance determining means is utilized to determine the score. In some cases, playing cards are utilized to determine the score independently of any chance determining means. However, in each case, scoring is a simple arrangement which has no challenge and accordingly is quite unattractive for continued playing.

Additionally, each of the board games simulate some type of an activity. For example, some board games are based upon economic situations such as the purchase of property, the investment in business opportunities, or the like. In other games they utilize particular sporting games such as football, baseball, or the like.

However, many of these situations are not very dynamic and do not provide sufficient stimulation for continued playing. As a result, often such games are disregarded after having been played a few times and do not provide sustained interest for continued playing.

SUMMARY OF THE INVENTION

It is accordingly an object of the present invention to provide a board game which avoids the aforementioned problems of prior art games.

Another object of the present invention is to provide a board game which utilizes olympic atheltic events as the background situation for the game.

Yet another object of the present invention is to provide a board game which utilizes a combination of chance determining means and playing cards to determine the scoring and winning of the game.

Another object of the present invention is to provide a board game having a series of athletic events representing olympic events and utilizing chance means to determine the point score of each athletic event.

Still a further object of the present invention is to provide a board game which includes a series of olympic athletic events as the particular playing situations and utilize a pair of dice to select particular cards which indicate the point score of each athletic event.

Another object of the present invention is to provide a board game which can be utilized to represent olympic athletic events and includes a men's olympic event version and a women's olympic event version.

Briefly, the invention comprises a board game having a playing board which includes a plurality of concentrically increasing scoring areas which substantially cover the entire playing board. Each scoring area is uniquely identifiable from the other areas. A series of event playing stations are formed peripherally about the playing board and overly portions of the scoring areas. Each playing station is identified by a particular event to be played.

A set of cards is associated with each of the playing stations. Each card within a set has one side thereof correspondingly identified with the particular event of the associated station. The other side of each card contains a unique event playing condition and point value.

Playing pieces are provided for each of the players. All of the playing pieces can be simultaneously positioned within a single playing station. A pair of dice are utilized for throwing onto the scoring areas and selecting a particular one of the cards from the set of cards. Scoring sheets are utilized for scoring the results of each event. The scoring sheets have tabulated on them the various events and include room for scoring the point scores for each player on each event.

The foregoing objects, features and advantages of the invention will, in part, be pointed out with particularity, and will, in part, become obvious from the following more detailed description of the invention, taken in conjunction with the accompanying drawing which forms an integral part thereof.

BRIEF DESCRIPTION OF THE DRAWING

In the drawing.

In the various figures of the drawing, like reference characters designate like parts.

DESCRIPTION OF THE PREFERRED EMBODIMENTS

Figure 1:
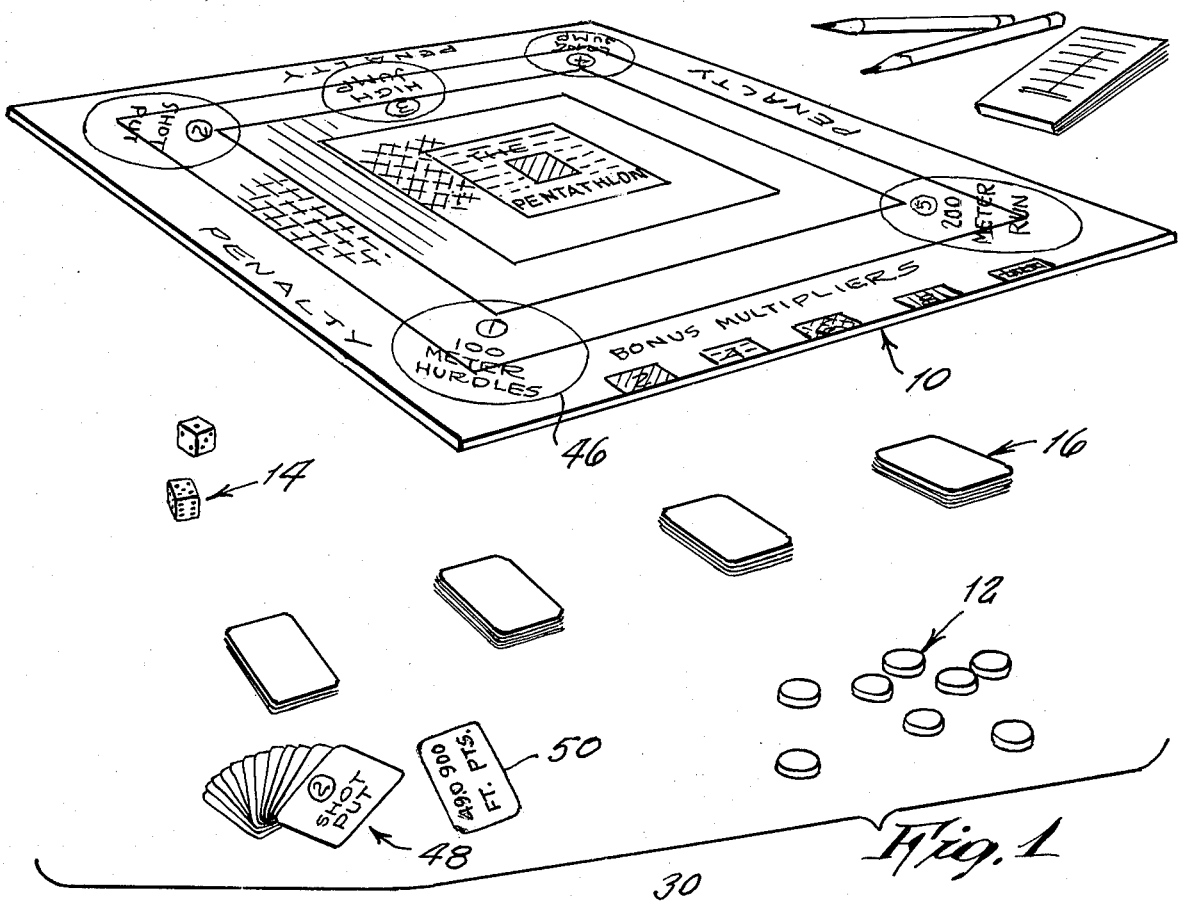
FIG. 1 is a composite isometric view showing the various parts of the board game of the present invention.

Referring now to FIG. 1, there are shown the various components of the present invention. Specifically, there are included a playing board shown generally at 10, a plurality of playing pieces shown generally at 12, with a playing piece for each player, a pair of dice 14 and sets of playing cards, a typical set being shown at 16.

Figure 2:
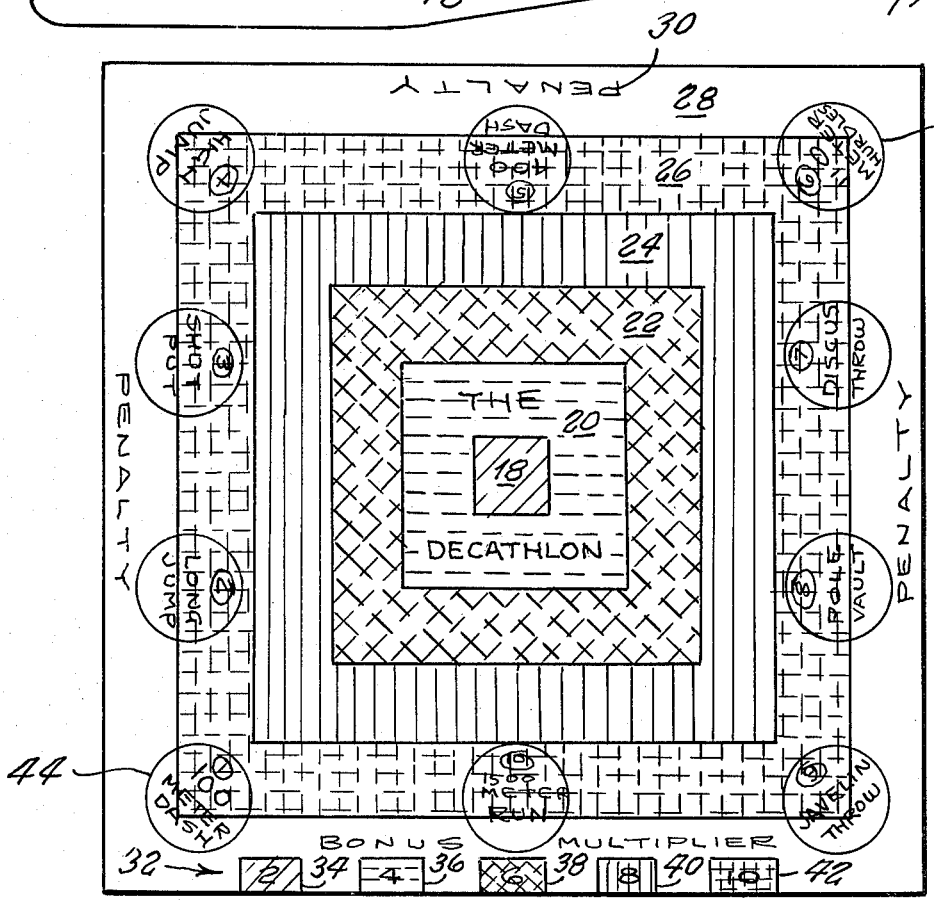
FIG. 2 shows a top view of an alternate embodiment of the playing board of the board game of the present invention.

With reference to FIG. 2 for purposes of clarity, the playing board includes a plurality of concentrically increasing scoring areas. Particularly, the center area 18 is shown as brown, which is surrounded by a larger square area 20 shown as grey. The additional concentric areas of increasing larger size include area 22 of orange color, the area 24 of red color, the area 26 of yellow color and the outside area 28 of white color. The outside area is designated as a penalty area by means of the indicia. In order to identify the particular areas and the multiplication value of each area there is provided a key code 32 in the bottom of the penalty area. The key code has the boxes 34 which identify the innermost brown area as a two multiplier area, the box 36 which identifies the grey area as a four multiplier, the box 38 which identifies the orange as a six multiplier the box 40 which identifies the red area as an eight multiplier, and the box 42 which identifies the outermost yellow area as a ten multiplier.

Formed peripherally about the playing board, are a series of event playing stations 44. These areas are shown as circular areas and overlie portions of both the yellow area 26 and the white outer penalty area 28. The event playing areas are each identified with a particular athletic event of the olympic games. They are identified sequentially from the number 1 through the number 10.

The first playing area 1 represents the 100 meter dash athletic event. The other areas are identified as area 2 being the long jump, the area 3 being the shot put, the area 4 being the high jump, the area 5 being the 400 meter dash, the area 6 being the 110 meter hurdle, the area 7 being the discus throw event, the area 8 being the pole vault event, the area 9 being the javelin throw event and the area 10 being the 1500 meter run.

The playing field shown in FIG. 2 represents the Decathlon version of the game which includes 10 events and represents the 10 men's events in an olympic game. The game version shown in the playing field of FIG. 1 is referred to as the Pentathlon and has five events representing the 5 women's events in an olympic game. The 5 athletic events shown in the playing board of FIG. 1 are each included within a circular event playing station 46 and are identified by the playing areas 1–5. The first event is the 100 meter hurdle, the second event is the shot put, the third is the high jump, the fourth is the long jump and the fifth is the 200 meter run.

For each of the playing events there is provided a set of cards. Each set of cards includes twelve individual cards. As shown in FIG. 1 for the five athletic events indicated on the playing field there are five sets of cards each set having twelve individual cards.

With reference now to the particular set of cards shown at 48 it will be noted that the top of each card is identified with a simlar identification as is the associated atheltic event. For example, the set of cards 48 include the identification No. 2 representing the shot put athletic event. On the reverse side of each card there is a unique playing condition, such as the distance, height, or time to be achieved in the event. There is also included the point score. As shown by the reverse side of the card 50, there is indicated that for the shot put event the number of feet indicated on this card is 49.0 which achieves a point score of 900 points.

For the Decathlon game as shown by the playing board of FIG. 2 the following are the playing conditions and point values on the reverse side of each of the sets of cards.

THE DECATHLON POINT CARDS

| 1 100 meter dash | | 2 Long Jump | | 3 Shot Put | |
|---|---|---|---|---|---|
| Seconds | Points | Feet | Points | Feet | Points |
| 10.0 | 1000 | 26.0 | 950 | 53.0 | 900 |
| 10.2 | 950 | 25.6 | 900 | 52.0 | 850 |
| 10.4 | 900 | 25.0 | 850 | 51.0 | 800 |
| 10.6 | 850 | 24.6 | 800 | 50.0 | 750 |
| 10.8 | 800 | 24.0 | 750 | 49.0 | 700 |
| 11.0 | 750 | 23.6 | 700 | 48.0 | 650 |
| 11.2 | 700 | 23.0 | 650 | 47.0 | 600 |
| 11.4 | 650 | 22.6 | 600 | 46.0 | 550 |
| 11.6 | 600 | 22.0 | 550 | 45.0 | 500 |
| 11.8 | 550 | 21.6 | 500 | 44.0 | 450 |
| 12.0 | 600 | 21.0 | 450 | 43.0 | 400 |
| 12.2 | 450 | 20.6 | 400 | 42.0 | 350 |

| 4 High Jump | | 5 400 Meter Dash | | 6 110 Meter Hurdles | |
|---|---|---|---|---|---|
| Feet | Points | Seconds | Points | Seconds | Points |
| 7.3 | 975 | 53.0 | 400 | 16.0 | 300 |
| 7.0 | 950 | 52.0 | 450 | 15.5 | 350 |
| 6.10 | 925 | 51.0 | 500 | 15.0 | 400 |
| 6.8 | 900 | 50.0 | 550 | 14.8 | 450 |
| 6.6 | 875 | 49.0 | 600 | 14.6 | 500 |
| 6.4 | 850 | 48.8 | 650 | 14.4 | 550 |
| 6.2 | 825 | 48.6 | 700 | 14.2 | 600 |
| 6.0 | 800 | 48.4 | 750 | 14.0 | 650 |
| 5.10 | 775 | 48.2 | 800 | 13.8 | 700 |
| 5.8 | 750 | 48.0 | 850 | 13.6 | 750 |

-continued

THE DECATHLON POINT CARDS

| | | | | | |
|---|---|---|---|---|---|
| 5.6 | 725 | 47.8 | 900 | 13.4 | 800 |
| 5.4 | 700 | 47.6 | 950 | 13.2 | 850 |

| 7 Discus Throw | | 8 Pole Vault | | 9 Javelin Throw | |
|---|---|---|---|---|---|
| Feet | Points | Feet | Points | Feet | Points |
| 180 | 900 | 16.5 | 975 | 260 | 890 |
| 175 | 875 | 16.0 | 950 | 250 | 870 |
| 170 | 850 | 15.8 | 925 | 240 | 850 |
| 165 | 825 | 15.4 | 900 | 235 | 830 |
| 160 | 800 | 15.0 | 875 | 230 | 810 |
| 155 | 775 | 14.8 | 850 | 225 | 790 |
| 150 | 750 | 14.6 | 825 | 220 | 770 |
| 145 | 725 | 14.4 | 800 | 215 | 750 |
| 140 | 700 | 14.2 | 775 | 210 | 730 |
| 135 | 675 | 14.0 | 750 | 205 | 710 |
| 130 | 650 | 14.8 | 725 | 200 | 690 |
| 125 | 625 | 14.6 | 700 | 195 | 670 |

| 10 1500 Meter Run | |
|---|---|
| Minutes | Points |
| 3:45 | 880 |
| 3:50 | 860 |
| 4:00 | 840 |
| 4:05 | 820 |
| 4:10 | 800 |
| 4:15 | 780 |
| 4:20 | 760 |
| 4:25 | 740 |
| 4:30 | 720 |
| 4:35 | 700 |
| 4:40 | 680 |
| 4:50 | 660 |

For the Pentathlon version as shown by the playing board of FIG. 1, the following are the values contained on the five sets of playing cards:

THE PENTATHLON POINT CARDS

| 1 100 meter Hurdles | | 2 Shot Put | | 3 High Jump | |
|---|---|---|---|---|---|
| Seconds | Points | Feet | Points | Feet | Points |
| 16.0 | 300 | 49.0 | 900 | 6.8 | 900 |
| 15.5 | 350 | 48.0 | 850 | 6.6 | 875 |
| 15.0 | 400 | 47.0 | 800 | 6.4 | 850 |
| 14.8 | 450 | 46.0 | 750 | 6.2 | 825 |
| 14.6 | 500 | 45.0 | 700 | 6.0 | 800 |
| 14.4 | 550 | 44.0 | 650 | 5.8 | 775 |
| 14.2 | 600 | 43.0 | 600 | 5.6 | 750 |
| 14.0 | 650 | 42.0 | 550 | 5.4 | 725 |
| 13.8 | 700 | 41.0 | 500 | 5.2 | 700 |
| 13.6 | 750 | 40.0 | 450 | 5.0 | 675 |
| 13.4 | 800 | 39.0 | 400 | 4.8 | 650 |
| 13.2 | 850 | 38.0 | 350 | 4.6 | 625 |

| 4 Long Jump | | 5 200 Meter Run | |
|---|---|---|---|
| Feet | Points | Seconds | Points |
| 22.6 | 800 | 26.0 | 350 |
| 22.0 | 775 | 25.8 | 400 |
| 21.6 | 750 | 25.6 | 450 |
| 21.0 | 725 | 25.4 | 500 |
| 20.6 | 700 | 25.2 | 550 |
| 20.0 | 675 | 25.0 | 600 |
| 19.6 | 650 | 24.8 | 650 |
| 19.0 | 625 | 24.6 | 700 |
| 18.6 | 600 | 24.4 | 750 |
| 18.0 | 575 | 24.2 | 800 |
| 17.6 | 550 | 24.0 | 850 |
| 17.0 | 525 | 23.8 | 900 |

Provided with each game are score sheets contained within a pad. The score sheets include a listing of the various events in the game. For some events there is only a single try while in other events there are two tries permitted as will hereinafter be explained. For each event there is provided a series of available entry columns for scoring. There are included the initial score, the modifications of those initial scores by adding the bonus multiplier scores, subtracting the penalty scores, and deriving the final scores, all as will be hereinafter explained.

A typical Decathlon score sheet is as follows:

THE DECATHLON SCORE SHEET

| Event | Initial score | Bonus +Multiplier score | −Penalty | = Final score |
|---|---|---|---|---|
| (1) 100 Meter Dash | | | | |
| (2) Long Jump - First try | | | | |
| Second try | | | | |
| (3) Shot Put - First try | | | | |
| Second try | | | | |
| (4) High Jump - First try | | | | |
| Second try | | | | |
| (5) 400 Meter Dash | | | | |
| (6) 110 Meter Hurdles | | | | |
| (7) Discus Throw - First try | | | | |
| Second try | | | | |
| (8) Pole Vault - First try | | | | |
| Second Try | | | | |
| (9) Javelin Throw - First try | | | | |
| Second try | | | | |
| (10) 1500 Meter Run | | | | |
| GRAND TOTAL | | | | |

The score sheet for the Pentathlon Score sheet is as follows:

THE PENTATHLON SCORE SHEET

| Event | Initial + Score | Bonus Multiplier score | Penalty | = Final Score |
|---|---|---|---|---|
| (1) 100 Meter Hurdle | | | | |
| (2) Shot Put - first try | | | | |
| second try | | | | |
| (3) High Jump - first try | | | | |
| second try | | | | |
| (4) Long Jump - first try | | | | |
| second try | | | | |
| (5) 200 Meter Run | | | | |

The rules for the playing of the game are as follows: The object of the game is to obtain the highest point score. In preparation for the game, each set of point cards are individually shuffled and placed around the playing board adjacent to the associated events playing station. The point cards are placed with their point values facing downward. All of the playing pieces, one for each of the individual players, are placed in the first event.

At the beginning of the game, one complete game qualifying round must be played by each of the players who wish to participate in the rest of the game. A total of at least 6,500 points must be achieved to qualify for the rest of the game. The rules scoring for the qualifying round are the same as for the playing of the rest of the game.

Each player takes one turn at the first event and computes his point total. In some events, two turns are allowed. These events are identified on the scoring pads. Specifically, in the Decathlon the Long Jump, Shot Put, High Jump, Discus Throw, Pole Vault and Javelin Throw all have two turns. In the Pentathlon version the Shot Put, High Jump and Long Jump, each have two turns. In these two turn events, each player takes one turn each before proceeding to the second turn in the same event. In the two turn events, only the highest final score is allowed.

The first player throws the dice. The dice must be thrown, not dropped. Attempts should be made to have the dice land in the highest multiplier area and at the same time avoidance of the penalty situation area.

Should the penalty situation area be reached, points are substracted from the score. If one or both dice come to rest on the perimeter of the playing area, or go off the playing board, a penalty situation arises. Each time this occurs, points are penalized. If one of the dice is in a penalty situation, there is a 50 point penalty. If both dice are in a penalty situation, there is a 100 point penalty. After a penalty situation, the dice must be thrown again. Again, attempts should be made to avoid reaching another penalty type situation. The penalty points are subtracted on the scoring sheets.

If no penalty situation is encountered, the two numbers shown on the dice are added together. The set of cards are then counted down to that number. The card that is reached representing the total number on the dice is then turned over and the number of points indicated is entered onto the score sheet as the initial score.

The color on which the dice have landed are then matched by means of the key code at the bottom of the playing board in order to determine the appropriate multiplying number. Each die number is multiplied by the number as indicated on the color chart. The results of the multiplication of each die by its multiplier value are then added together in order to obtain the bonus multiplier score. If the dice land on a line, the lower bonus multiplier must be used. The bonus multiplier score is then also entered onto the scoring sheet.

After each time a point card is used, it must be replaced in the same deck. The deck must then be shuffled before the dice are thrown again.

After all the players have competed in the first events, they can all proceed to the second event and continue in a like manner. Then, they can continue onto a third and subsequent events until all of the events have been completed.

The winner is the individual with the highest number of points. In case of a tie, after all of the events have been completed, the player with the highest total of points in any one event is the winner. If a tie remains, the player with the highest total in any two events is the winner.

Although a particular construction has been shown for the game, it will be appreciated that modifications can be made. For example, the particular scoring areas can be made in other configurations such as circles, rectangles, etc. Similarly the event playing stations can be made in other shapes. Also, other colors, or identifications of the areas can be utilized.

There has been disclosed heretofore the best embodiment of the invention presently contemplated. However, it is to be understood that various changes and modifications may be made thereto without departing from the spirit of the invention.

I claim:

1. A board game comprising:

a playing board having a plurality of concentrically increasing scoring areas substantially covering the entire playing board, each scoring area uniquely identifiable from the others;

a series of event playing stations formed peripherally about said playing board overlying portions of said scoring areas, each playing station identified by the particular event to be played;

a set of cards associated with each of said playing stations for serving as a first chance determining means;

a playing piece for each player, all the playing pieces being simultaneously positionable within a single playing station;

a standard pair of dice for serving as a projectile to land onto particular scoring areas and simultaneously serving as a chance determining means for selecting a particular card from within each set of the first chance determining means;

scoring sheets having all of the events tabulated thereon.

2. A board game as in claim 1 wherein each card of the same set has one side thereof correspondingly identified with the particular events of the associated station, and the other side thereof containing a unique event playing condition and point value.

3. A game board as in claim 2 and further comprising a key code area on the playing board for providing a correspondence between each scoring area and a multiplication value.

4. A board game as in claim 3 wherein the outermost scoring area is identifiable as a penalty area.

5. A board game as in claim 4, wherein said key code areas are formed in said penalty area.

6. A board game as in claim 3, wherein said scoring areas are a series of concentric squares.

7. A board game as in claim 6, wherein each event station is a circular area.

8. A board game as in claim 7, wherein each of said circular event stations overlap the outermost two concentric square areas.

9. A board game as in claim 2, wherein each scoring area is of a different color.

* * * * *